US005669766A

United States Patent [19]

Hufton

[11] Patent Number: 5,669,766

[45] Date of Patent: Sep. 23, 1997

[54] FOSSIL FUEL BURNERS

[75] Inventor: Peter F. Hufton, Etwall, England

[73] Assignee: Rolls-Royce Power Engineering plc, England

[21] Appl. No.: 387,866

[22] PCT Filed: Aug. 26, 1993

[86] PCT No.: PCT/GB93/01817

§ 371 Date: Mar. 24, 1995

§ 102(e) Date: Mar. 24, 1995

[87] PCT Pub. No.: WO94/05952

PCT Pub. Date: Mar. 17, 1994

[30] Foreign Application Priority Data

| | | | |
|---|---|---|---|
| Sep. 2, 1992 | [GB] | United Kingdom | 9218582 |
| Dec. 16, 1992 | [GB] | United Kingdom | 9226168 |
| Apr. 28, 1993 | [GB] | United Kingdom | 9308759 |

[51] Int. Cl.[6] ..... F23D 1/00

[52] U.S. Cl. ..... 431/187; 431/181; 110/261; 110/263; 239/553

[58] Field of Search ..... 431/181, 187, 431/159, 186; 110/263, 264, 265, 261; 239/553, 553.5

[56] References Cited

U.S. PATENT DOCUMENTS

| | | | |
|---|---|---|---|
| 1,342,135 | 6/1920 | Schmidt | 110/263 |
| 4,654,001 | 3/1987 | LaRue . | |
| 4,930,430 | 6/1990 | Allen et al. | 110/263 |
| 5,299,512 | 4/1994 | Olsen | 110/263 |
| 5,347,937 | 9/1994 | Vatsky | 431/187 |

FOREIGN PATENT DOCUMENTS

| | | | |
|---|---|---|---|
| 403241208 | 10/1991 | Japan | 110/263 |

*Primary Examiner*—Carl D. Price
*Attorney, Agent, or Firm*—Cushman, Darby & Cushman, IP Group of Pillsbury, Madison & Sutro, LLP

[57] ABSTRACT

A fossil fuel air burner nozzle is provided with a wall (22) at its inlet, in which are apertures (34) which narrow in a direction radially outward of the nozzle. Each aperture is axially aligned with a respective bluff member (18) at the outlet so as to deliver thereto a fuel air mix flow at a velocity which is graded in said radial direction so as to ensure flame retention on the bluff members (18).

6 Claims, 5 Drawing Sheets

FOSSIL FUEL BURNERS

FIELD OF THE INVENTION

The present invention concerns burner nozzles of the kind which direct streams of mixed fossil fuel and air into a combustion chamber, where the mix is burned so as to heat water and generate steam for the purpose of power generation.

BACKGROUND OF THE INVENTION

Such nozzles may be of circular or rectangular cross sectional shape, and in both cases comprise co-axial, nested passages which are fed from a common fuel/air input conduit, plus a further, outer passage for a flow of air per se.

U.S. Pat. No. 4,654,001 discloses a circular fuel burner nozzle which comprises an outer tubular housing having a stabiliser located therein to define coaxial passages. Members are provided intermediate the housing and the stabilizer to mix the fuel passing through the passages. Discharge vanes are disposed in the end region of the nozzle between the stabilizer and the tubular housing to reduce the turbulence of the mixed fuel as it emerges from the nozzle.

Although the fuel burner nozzle disclosed in U.S. Pat. No. 4,654,001 reduces NOx formation it is desirable to create conditions wherein once the fuel/air mix ignited, a flame attaches to the outlet plane of the nozzle and stays attached for the duration of the primary flow. In known arrangements, bluff members are provided about the outlet which enable the said attachment.

If the flow of fuel/air varies, problems arise by way of the flame detaching from the nozzle outlet. Rectangular nozzles suffer less from this phenomenon than do circular nozzles. In the latter type, swirl vanes have been incorporated in the outer fuel/air subsidiary flow passages and have reduced but not obviated the tendency of the flame to detach. Such vanes cannot be used in rectangular nozzles. Consequently some detachment occurs in both types of burner nozzle.

The present invention seeks to provide an improved fossil fuel/air burner nozzle.

According to the present invention a fossil fuel/air burner nozzle comprises a primary nozzle having nested, coaxial passages connected to a common supply conduit for the receipt of a flow of mixed fossil fuel and air and wherein the outer one of the nested passages is provided at its inlet end with a wall which lies in a plane normal to its axis, characterised in that the said wall has apertures therein which are spaced about said axis in symmetrical manner, and within its outlet end said passage is provided with a peripheral equi angular array of bluff members each of which is axially aligned with a respective aperture.

The cross sectional shape of a burner in accordance with the present invention may be circular or rectangular.

In one embodiment of the present invention the apertures are substantially triangular in profile, the apex or quasi apex thereof being at the radially outward portion of each aperture.

In a second embodiment of the present invention the apertures are trapezoidal in profile, the narrower end being radially outward of the wider end.

A burner in accordance with the present invention may include a further aperture wall arranged in face to face sliding engagement with said apertured wall, so as to enable variable overlapping of said apertures for achievement of aperture area variation.

BRIEF DESCRIPTION OF THE DRAWINGS

The invention will now be described by way of example and with reference to the accompanying drawings in which.

DETAILED DESCRIPTION OF THE INVENTION

Figure 1:
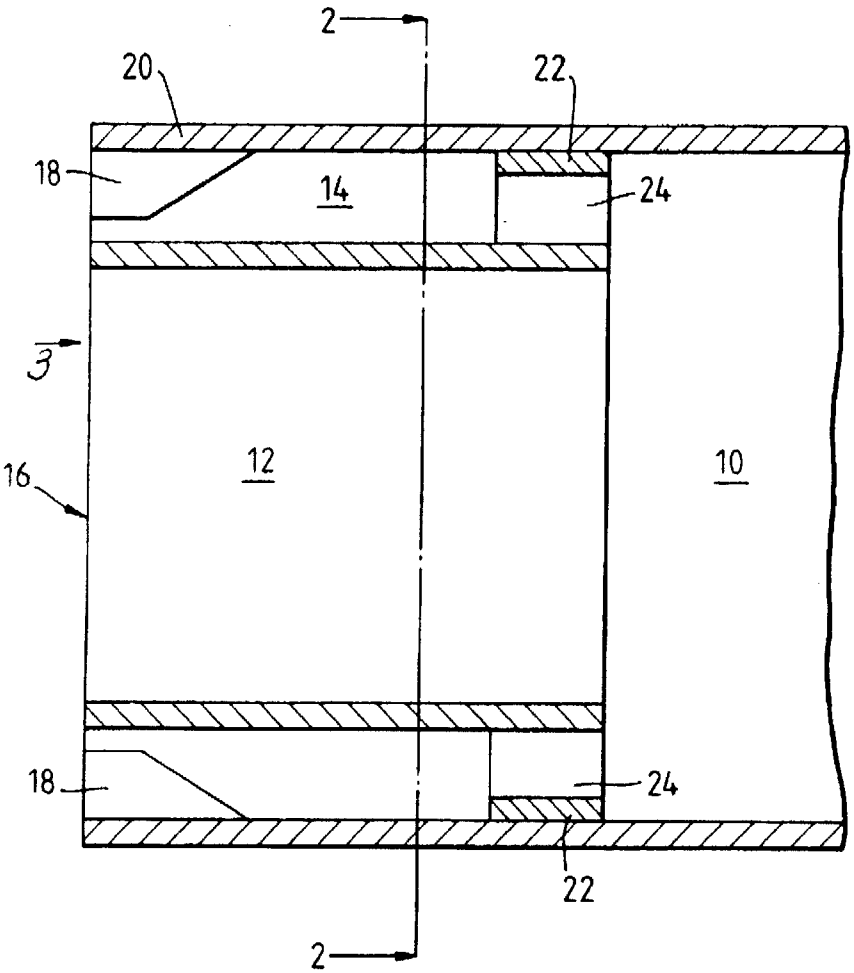
FIG. 1 is an axial cross sectional part view of a fossil fuel burner nozzle in accordance with one embodiment of the present invention.

Referring to FIG. 1. A main passage 10 passes a mixture of fossil fuel (eg coal) and air to two nested, coaxial passages 12 and 14 which are axially aligned therewith and removably joined thereto, by screw threads (not shown) or the like.

The central passage 12 is unobstructed and ejects a stream of mixed fuel and air from its exit nozzle 16.

The outer passage 14 has bluff members 18 arranged around the interior downstream periphery of its outer wall 20, in known manner. The function of the bluff members 18 is to generate local recirculation flow patterns, the function of which is to effect continuous flame ignition. This is a known function.

A wall 22 is provided at the inlet of the passage 14, which wall has a number of apertures 24 therein, through which that mix of fuel and air which is to flow through passage 14 must pass.

Figure 2:
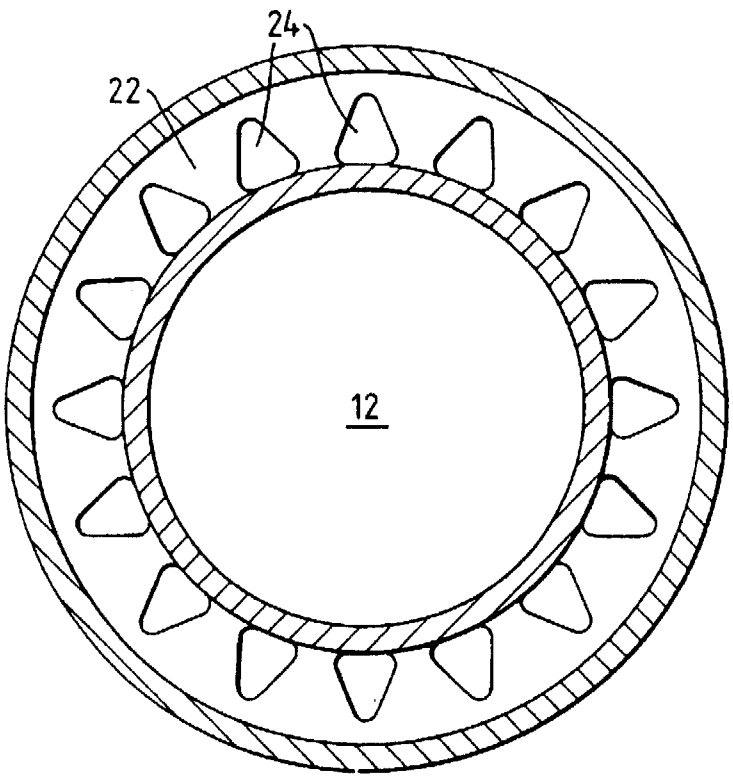
FIG. 2 is a view on line 2—2 in FIG. 1.
Figure 6:
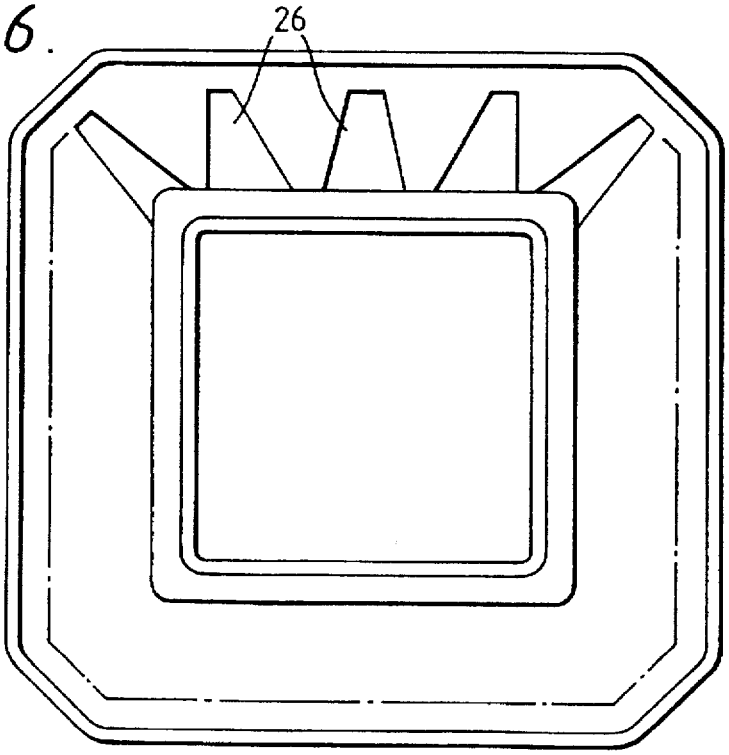
FIG. 6 is a further aspect of the present invention.

In the present example, the shape of each aperture is substantially triangular, which is best seen in FIG. 2. The base of each triangle lies on or closely adjacent the inner surface of the outer passage 14. Thus in a preferred embodiment, the apertures are wider at positions close to the central passage 12 than at positions remote therefrom. Such arrangements can be achieved with profiles other than triangular, eg pear shaped or mainly trapezoidal as shown at 26 in FIG. 6.

The function of the apertures is to slow the velocity of the fuel/air mix in the passage 14 in a graded manner, before it reaches the bluff members 18.

The manner of grading is such that the flow velocity inwardly of the bluff members 18 ie the velocity of the fuel/air mix which passes through the space between each bluff member 18 and the adjacent wall surface 23 is largely unaffected, whereas the fuel/air flow velocity in line with the bluff members 18 is reduced at an increasing rate as the magnitude of the constriction in the profile of the apertures 24 increases in a direction across the passage 14, ie in the case of a circular cross section passage, radially outwardly.

It will be appreciated that the flow velocity of the fuel/air mix which passes between adjacent bluff members 18 is also slowed by virtue of the fuel/air flow expanding on the immediate downstream side of the apertures, into the low pressure area which is generated by the constricted portions of the apertures 24.

Figure 3:
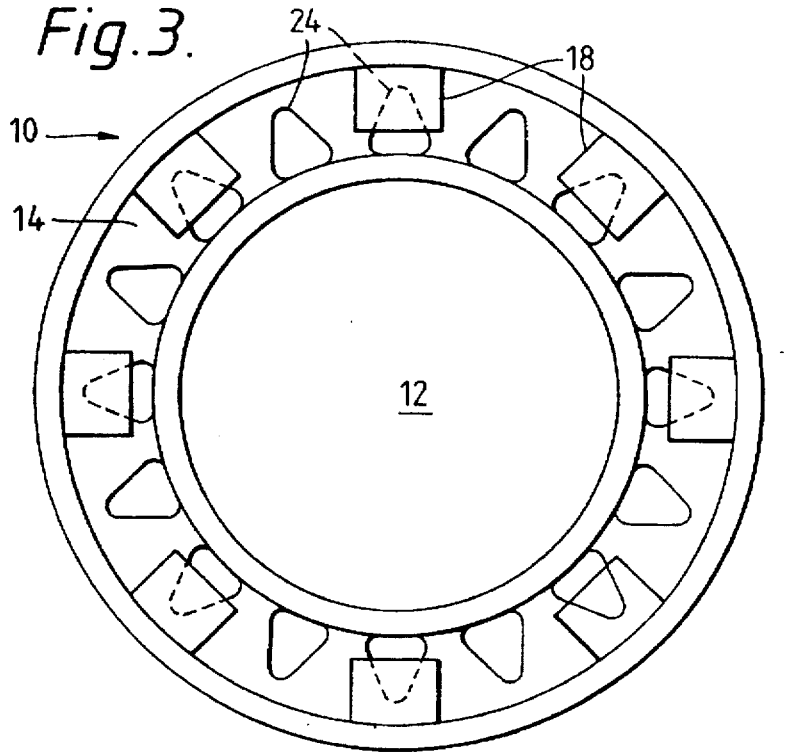
FIG. 3 is a view in the direction of arrow 3 in FIG. 1.
Figure 4:
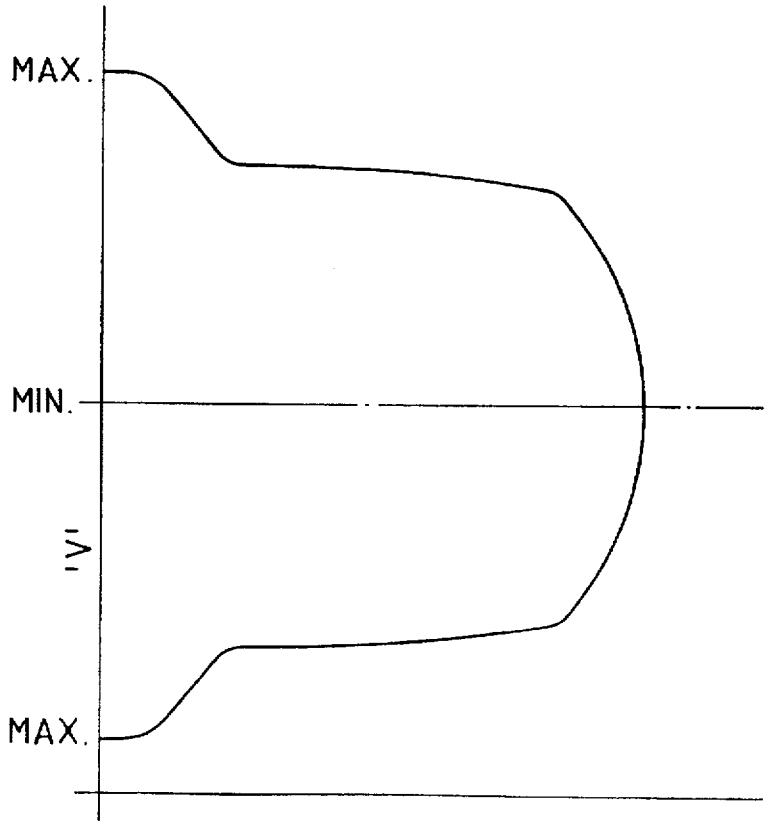
FIG. 4 is a fuel/air flow velocity diagram.

Referring now to FIGS. 3 and 4. The angular positions of the apertures 24 of the present example with respect to the bluff members 18 is depicted. This arrangement produces the velocity profile of the fuel/air mix across the exit faces of the passages 12 and 14 as depicted in FIG. 4. The angular relationships shown should not be regarded as being limited thereto.

The velocity profile is shown in FIG. 4 and is seen to have a low value at the outer extremity of the passage 14, which increases to a maximum at the inner surface thereof, and which nearly equals the velocity of the main flow from the passage 12.

Figure 5:
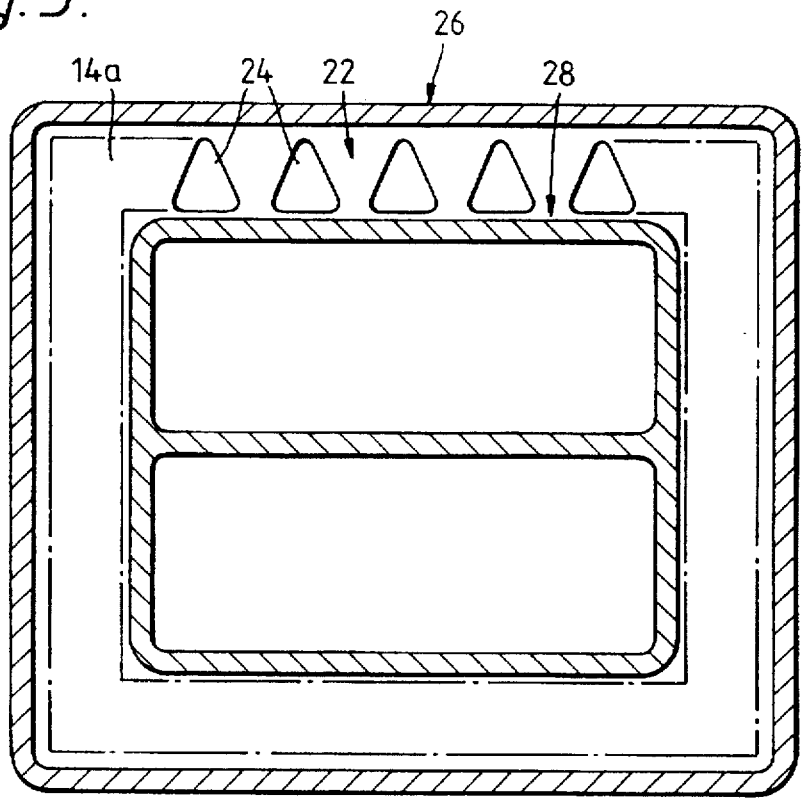
FIG. 5 is an end view of a fossil fuel burner nozzle in accordance with a further aspect of the present invention.

FIG. 5 depicts an alternative arrangement in which a rectangular primary nozzle 26 has a multi passaged structure 28 for the main flow, and which is surrounded by a further passage 14*a* for the subsidiary flow. In this example the wall 22 of the present invention is included and is provided with apertures 24 as is described hereinbefore, so as to achieve similar benefits with the rectangular nozzle.

As stated hereinbefore, present nozzles of circular cross section have been provided with fuel/air swirlers in the passage corresponding to the passage 14 herein, with resulting benefit. Rectangular nozzles however, were not suitably shaped to have them. The present invention is shown to have efficacy in both circular and rectangular cross section nozzles and moreover, obviates the need for swirler devices in the circular cross section burners. It is envisaged however, that some nozzle designs may benefit by employing both appertures and swirlers.

It is envisaged that the wall 22 be modified to provide a further embodiment of the present invention, thus there could be provided two walls, one fixed as described hereinbefore, and one movable laterally about a position coincident with the fixed wall.

Both walls would be provided with apertures, eg of the kind described hereinbefore and, in nominal positions would be such that the apertures in one wall are positioned with respect to the apertures in the other wall, so as to overlap and thus expose apertures of reduced area.

The cross sectional areas could be varied from a minimum to a maximum during operation, thus providing a means for fine adjustment of the restriction of flow during operation of the associated nozzle as shown in FIG. 1 where a second plate is illustrated only partially overlapping with the apertures 24 of plate 22.

If utilised in the nozzle of FIG. 2, the movement of the movable wall would be rotary, in the nozzle of FIG. 5 it would be linear.

In each case at least the central nozzle and apertured wall could be made from ceramic material, to counter erosion by passage therethrough of the fossil fuel.

Figure 7:
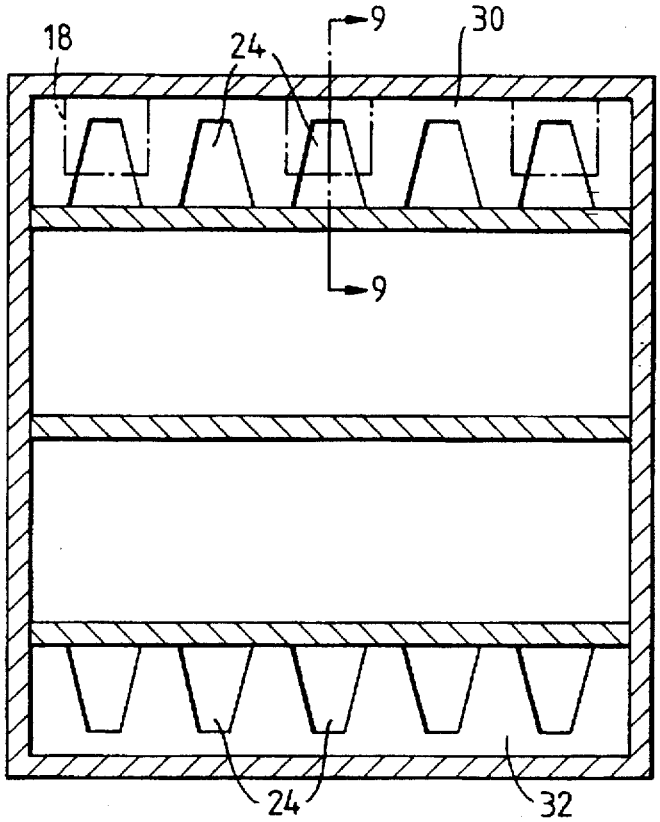
FIGS. 7 and 8 depict still further embodiments of the present invention.

A further embodiment of the present invention is depicted in FIG. 7 wherein the apertures 24 are only provided in walls 30, 32 at the top and bottom respectively of the burner nozzle inlet. This arrangement provides local flame attachment at the top and bottom bluff members 18 and achieves both a satisfactory low NOx production and a reduced nozzle pressure drop.

Figure 8:
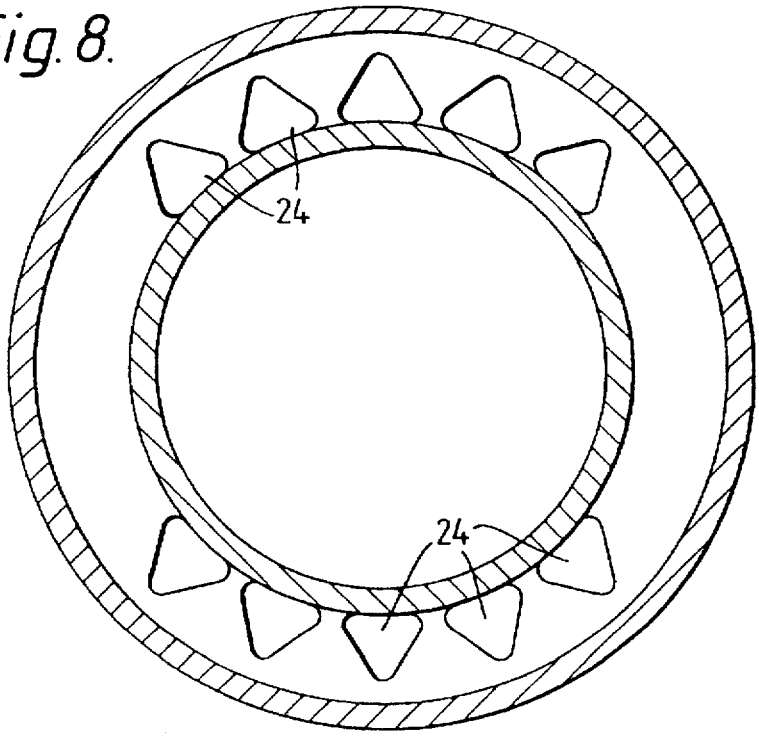

A similar effect can be achieved in circular nozzles of the kind depicted herein with respect to FIGS. 1 to 3, by arranging apertures 24 in opposed, symmetrical arcuate manner as depicted in FIG. 8, rather than totally circumferentially.

Figure 9:
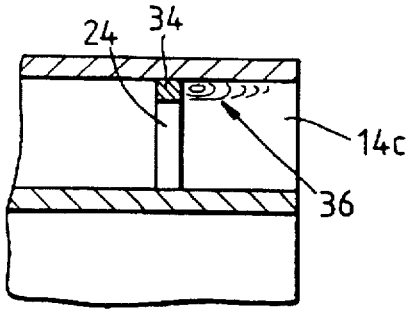
FIG. 9 is a cross-sectioned part view in the direction of arrows 9—9 in FIG. 7.

Referring now to FIG. 9. A step 34 is created in the wall 30 by each aperture 24, which generates a recirculatory flow of air along the passage wall and which extends to the nozzle plane. This is advantageous in that it entrains hot gases from the furnace and thus assists fuel and air heating with consequently easier ignition.

Figure 10:
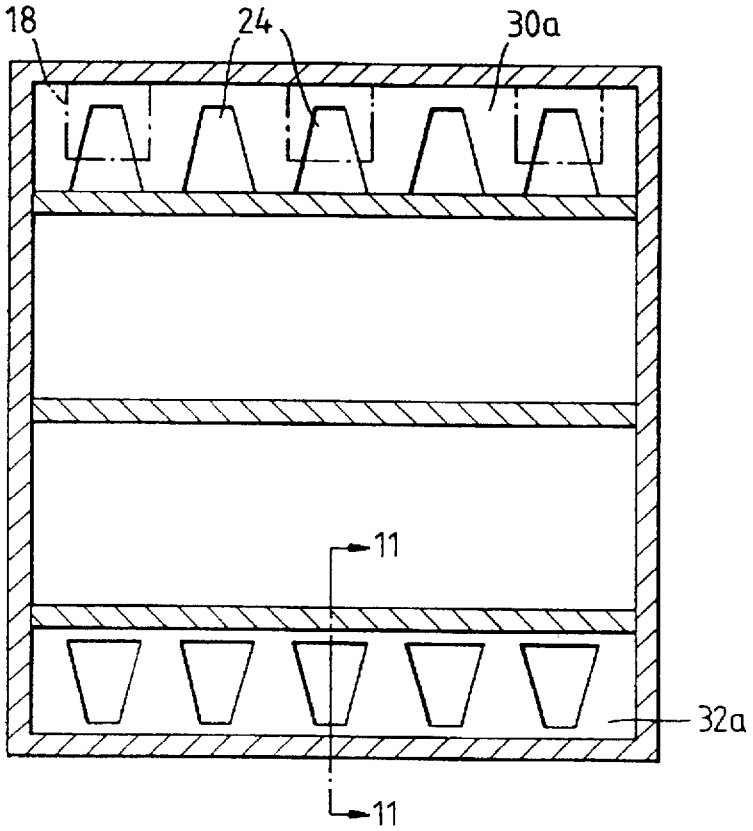
FIGS. 10 and 11 depict other modifications applied to the fossil fuel burner of FIG. 7.
Figure 11:
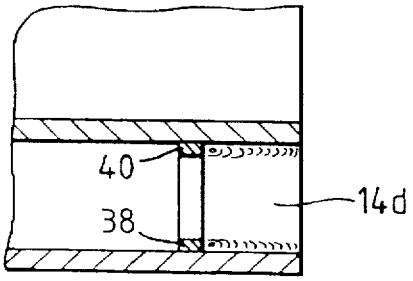

A problem arises however, in that ash particles are entrained with the gas. In the passageway 14*c* in the top of the nozzle this is not serious since any ash particles that fall out of the slow moving recirculation region fall into the fast flowing air stream and are carried back to the furnace. In the bottom passageway 14*d* (FIG. 11) however, ash particles can only fall through the slow moving recirculation region onto the nozzle plate 30 and the surface of the passageway 14*d* to cause blockage and prevent satisfactory flame stabilisation. To counter the tendency to block, the nozzle plate 32*a* has its apertures 24 formed in positions which reduce the height of each lower step 38 and provide a further step 40 above the apertures as is shown in FIG. 10. The recirculation region is thus reduced in depth and ash build up is prevented. The recirculation produced by the upper steps is also shallow and further, gravity causes ash to fall out, should any penetrate the recirculation region.

Tests have shown that reducing the height of the lower step as described hereinbefore, results in the weakening of flame attachment at the bottom portion of the nozzle plane. However, despite the resulting combination of a strong attachment at the top and weak attachment at the bottom, the low NOx performance is not affected.

I claim:

1. A fossil and air burner nozzle comprising a primary nozzle having an axis and nested, inner and outer coaxial passages, each passage being connected to a common supply conduit for receipt of a flow of mixed fossil fuel and air, said outer passage having an inlet end provided with a wall having apertures therethrough, said apertures being spaced about said axis in a symmetrical manner, said outer passage having an outlet end provided with a peripheral, equiangular array of bluff members with each bluff member being axially aligned with a respective aperture in said wall.

2. A fossil fuel and air burner nozzle as claimed in claim 1 characterised in that the cross sectional shape of the nozzle is circular.

3. A fossil fuel and air burner nozzle as claimed in claim 1 characterised in that the cross sectional shape of the nozzle is rectangular.

4. A fossil fuel and air burner nozzle as claimed in claim 1 characterised in that it includes a further apertured wall arranged in face to face sliding engagement with said apertured wall, so as to enable variable overlapping of said apertures for achievement of aperture area variation.

5. A fossil fuel and air burner nozzle as claimed in claim 1, wherein said apertures are substantially triangular in shape having an apex located at a radially outer position of each aperture.

6. A fossil fuel and air burner nozzle as claimed in claim 1, wherein said apertures are trapezoidal in shape having a narrow end located radially outwardly of a wider end.

* * * * *